United States Patent [19]

Hedberg

[11] 4,241,492

[45] Dec. 30, 1980

[54] PROCESS FOR MANUFACTURE OF VALVE SEAT

[75] Inventor: Arthur S. Hedberg, Park Ridge, Ill.

[73] Assignee: Wells Manufacturing Company, Skokie, Ill.

[21] Appl. No.: 971,697

[22] Filed: Dec. 21, 1978

[51] Int. Cl.[3] ..... B22D 11/126

[52] U.S. Cl. ..... 29/527.6; 249/57; 249/126; 249/119; 164/350

[58] Field of Search ..... 29/527.6; 164/350, 27; 249/126, 57, 160, 119

[56] References Cited

U.S. PATENT DOCUMENTS

| | | | |
|---|---|---|---|
| 1,263,271 | 4/1918 | Mossberg | 29/527.6 |
| 1,359,196 | 11/1920 | Rau | 249/126 X |
| 2,812,571 | 11/1957 | Strom | 249/57 X |
| 3,786,857 | 1/1974 | Sutherland | 249/119 |
| 4,112,997 | 9/1978 | Chandley | 164/350 |

FOREIGN PATENT DOCUMENTS

| | | | |
|---|---|---|---|
| 621281 | 5/1961 | Canada | 164/350 |
| 364225 | 11/1922 | Fed. Rep. of Germany | 164/350 |
| 935146 | 11/1955 | Fed. Rep. of Germany | 249/126 |

*Primary Examiner*—Francis S. Husar
*Assistant Examiner*—V. K. Rising
*Attorney, Agent, or Firm*—Hill, Van Santen, Steadman, Chiara & Simpson

[57] ABSTRACT

The present invention concerns a method of manufacture of valve seats which comprises forming a series of vertically stacked molds each having at least one mold cavity with a configuration approximating that of a ring-shaped valve seat insert blank. After the molds are formed, they are stacked and the cavities are connected by a common molten metal passageway in such a way that the passageway connects with an axially facing outer surface of each mold cavity to provide a lap gating relationship. Molten metal is then poured into the lap gated passageway to form a series of valve seat insert blanks each having a gate formed on an axially outer face. The blanks are then removed from the molds. Various grinding operations are then applied to the blanks and the axially outer-facing surfaces of the blanks are ground to remove the gates to form valve seats for use in internal combustion engines.

12 Claims, 13 Drawing Figures

Fig 1
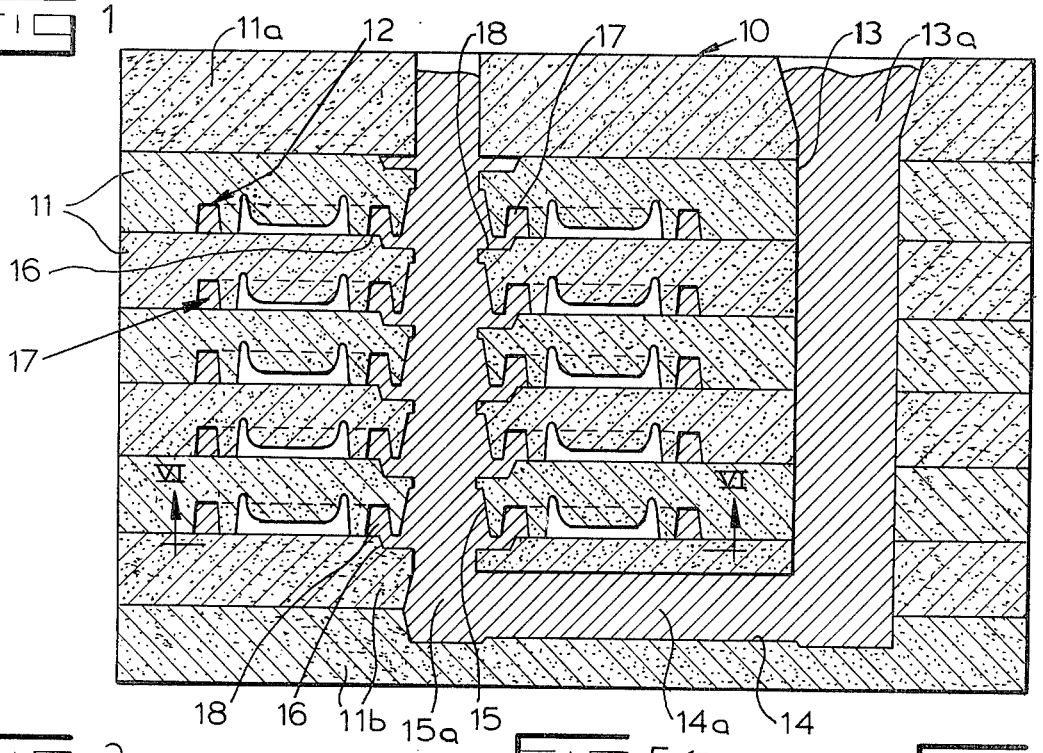
Fig 2
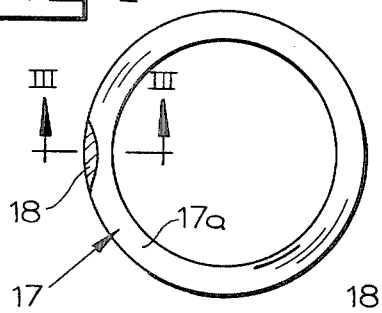
Fig 5 (PRIOR ART)
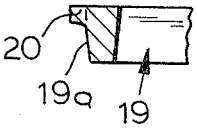
Fig 4 (PRIOR ART)
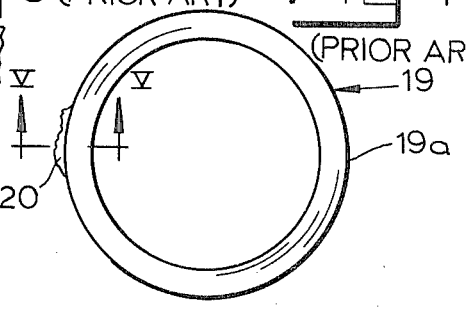
Fig 3
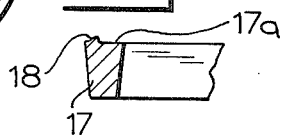
Fig 6
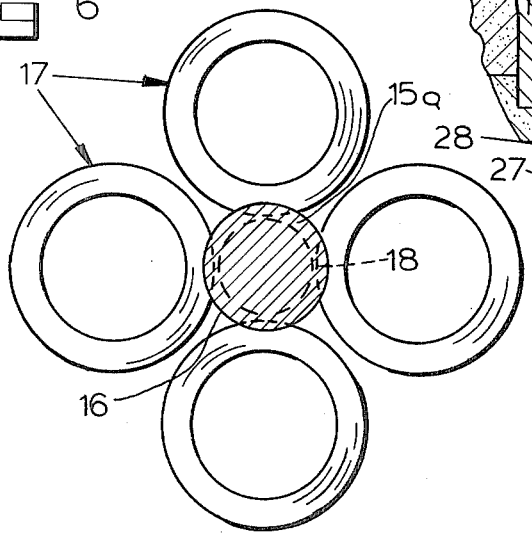
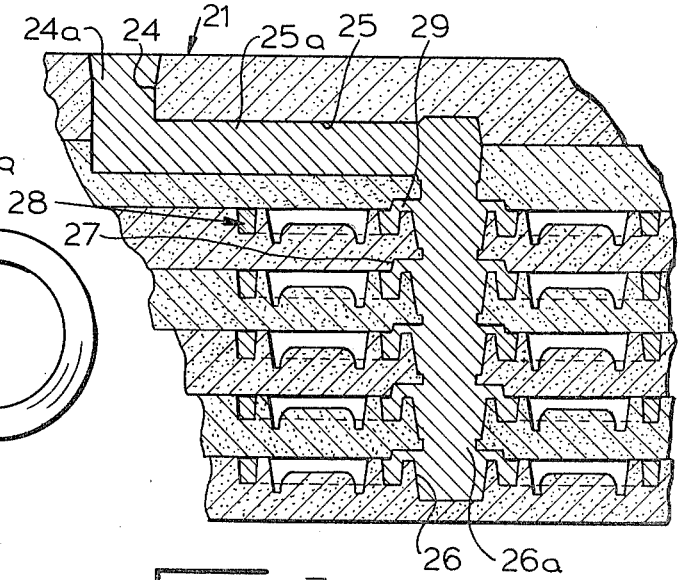
Fig 7

PROCESS FOR MANUFACTURE OF VALVE SEAT

The present invention relates to the production of castings and is more particularly concerned with a new and improved method for use in the manufacture of valve seat insert blanks.

In the past, in the large scale production of valve seat castings, it has been the practice to form the castings in molds where the gates would be positioned on the outer circumference of the ring-shaped valve seat insert blanks. As a result, it has been necessary to grind the outer circumference of the casting to remove the gate, which has been a very costly operation. In the past grinding operations, it will be appreciated that special machinery was required to grind the outer circumference of the valve seat insert blank, and this operation not only has been costly but grind cracks were commonly generated in the outside diameter of the valve seat insert due to the nature of the grinding operation which results in defects in the valve seat insert thus requiring the casting to be discarded. Also, it was necessary to grind the in-gate flush with the casting in order to maintain maximum concentricity between the outside diameter and the inside diameter which was a costly operation. In the past, considerable thought has been given to automating the operation, or to eliminating the operation entirely. The above-described process for manufacture of valve seat castings was used in industry for many years, and many millions of castings have been manufactured using these described techniques.

According to the present invention, the gating of valve seat inserts on circumferentially outer surfaces can be totally limited, since the gating is provided on an axially facing surface of the valve seat insert casting. As a result of the development of the new method of gating on the valve seat inserts, outer diameter gate grind cracks generated in the outer diameter gate grinding operation are eliminated, and hence material cost savings can be obtained.

According to important features of this invention, a new and improved method of manufacture of valve seat inserts has been developed and which comprises the steps of forming a series of vertically stacked molds each having at least one mold cavity with a configuration approximating that of a ring-shaped valve insert blank, stacking and connecting the formed molds by a common molten metal passageway in such a way that the passageway connects with an axially facing outer surface of each mold cavity to provide a lap gating relationship, pouring molten metal into the lap gated passageway to form a series of valve insert blanks each having a gate formed on an axially outer face, removing blanks from the molds, and grinding the axially outer-facing surfaces of the blanks to remove the gates and finish the inserts.

According to other features of this invention, a new and improved mold assembly has been developed wherein a series of molds are provided each having a series of mold cavities disposed in axially lapped relation with respect to the molten metal passageway in communication therewith to enable molten metal to flow into the cavities provided in each of the molds thus forming the axially facing gates on the valve seat insert blanks.

Still further features of this invention relate to a new and improved mold assembly wherein a molten metal passageway is positioned in underlapped or overlapped relation to each of the mold cavities.

Other features of the invention relate to a mold metal passageway being positioned in lapped relation to each of the mold cavities. In view of the foregoing, it will thus be appreciated that an important object of this invention is to provide a new and improved method and apparatus for manufacture of new and improved valve seat insert blanks plus resultant valve seat inserts.

Still another object of this invention is to provide a new and improved method of manufacture of valve seat inserts which eliminates a difficult manufacturing operation where before it has been necessary to machine the gates off of circumferentially outer surfaces of the valve seat insert. Still another object of this invention is to provide a new and improved method of manufacture of valve seat inserts where outer diameter gate grind cracks can be totally eliminated.

Still another object of this invention is to provide a new and improved method of manufacture of valve seat inserts where the costs of manufacture can be materially reduced.

Yet another object of this invention is to provide a new and improved mold assembly for manufacture of valve seat inserts.

Other objects and features of this invention will more fully become apparent in view of the following detailed description of the drawings wherein several embodiments are illustrated.

FIG. 1 is a vertical section of a stacked type mold assembly embodying features of my invention;

FIG. 2 is a top plan view of a valve insert manufactured in the mold assembly shown in FIG. 1 illustrating the gate on an axial face thereof;

FIG. 3 is an enlarged fragmentary vertical section taken on the line III—III looking in the direction indicated by the arrows as seen in FIG. 2;

FIG. 4 is a top plan view of a valve seat illustrating the old prior art rings as they were previously manufactured using the old mold assembly and according to the old method;

FIG. 5 is an enlarged fragmentary vertical section taken on the line V—V looking in the direction indicated by the arrows as seen in FIG. 4 and also illustrating the prior art valve seat.

FIG. 6 is a horizontal section taken on the line VI—VI in the direction indicated by the arrows as seen in FIG. 1 for the purpose of illustrating the lap gating relationship;

FIG. 7 is a fragmentary cross-sectional view similar to FIG. 1, only illustrating a modified stacked mold assembly;

Figure 8:
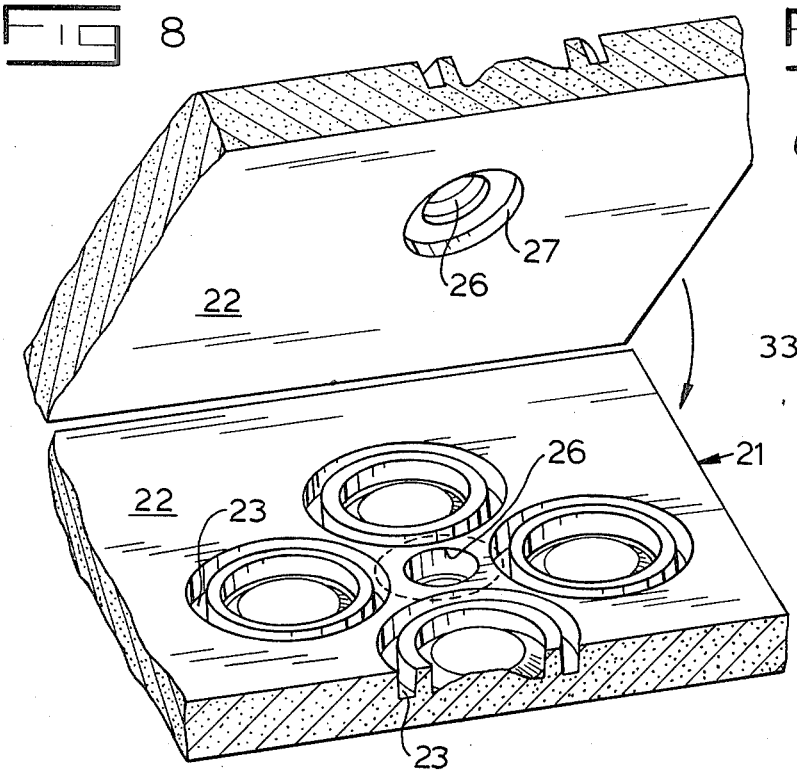
FIG. 8 is an enlarged fragmentary perspective view of a pair of molds of the type shown in FIG. 7 illustrated in a spread apart position.

The reference numeral 10 indicates a vertically stacked mold assembly as is illustrated in FIG. 1. The mold assembly 10 includes a series of molds or mold sections 11, a top cap mold or mold section 11*a* and a pair of bottom molds 11*b* all of which coact together for receiving molten metal alloy which can be of any suitable type previously known by those skilled in this art. The mold assembly 10 is provided for the purpose of transmitting molten material into vertically spaced ring-shaped valve insert mold cavities 12. In order to attain this end, the mold assembly 10 is provided with a down-sprue passageway 13, a bottom runner passageway 14 formed in the pair of bottom molds or mold sections 11*b*, and an up-sprue passageway 15 which is in direct communication with the mold cavities 12 by vertically spaced linking circular disc-shaped passageways 16 which radially underlap the cavities 12 so that when fluid metal is caused to be flowed through the down-sprue passageway 13 into the bottom runner passageway 14 and then up through the up-sprue passageway 15, the metal flow will be through the circular disc-shaped passageways 16 into the molds 11. When the molds 11 are disassembled from one another, the blanks 17, as shown in FIG. 1, are broken away from the sprues and each of the blanks 17 is left with a gate 18 at the area where the ring-shaped valve insert blank 17 breaks from the up-sprue 15*a* and particularly at the point where the molten metal flows from the disc-shaped passageway 16 into the mold cavity leaving the gate 18.

In the process of forming the insert blanks 17, a down-sprue 13*a* and a bottom runner 14*a*, as well as the up-sprue 15*a*, are all formed and are left as remelt material.

It will thus be seen from a consideration of FIGS. 2 and 3 that the gate 18 is formed on an axial face 17*a* of the blanks 17 which is in contrast to the prior art exhibited in FIGS. 4 and 5. In FIGS. 4 and 5, the old type blanks 19 are illustrated. Each of the blanks has an outer circumferential surface 19*a* and in the old process of forming the old type of blanks 19, gates 20 were left on the outer-circumferential surface 19*a*. At the outer-circumferential surface 19*a*, it was far more difficult to remove the gate 20 because of the difficult nature of the grinding operation required to reshape the outside diameter of the valve blanks 19 without causing cracks in the blanks. Also, with the old method, there was a tendency for negative gate break-in to occur, and this type of defect was located in a critical area of the blanks where imperfections could not be tolerated. According to important features of the present invention, where the new and improved mold assembly 10 is employed and where the new and improved method is utilized for manufacture of the blanks 17, any minute foreign particle caught in the in-gate would be in a noncritical area and could then be removed in the machining operation with far less difficulty and with less likelihood of damage being occurred to the blanks.

According to other features of the invention, concentricity between the I.D. and O.D. is improved as the centerless grind operation on the O.D. is not influenced by either a positive or negative O.D. gate grind operation, as that operation can be now eliminated. Also, O.D. gate-grind cracks generated by the O.D. gate-grind operation previously required in the formation of blanks of the type identified at 19 in FIGS. 4 and 5 can now be eliminated.

As will be seen from FIGS. 7 and 8, a modified vertical stacked mold assembly 21 has been illustrated. This assembly employs a construction for producing an overlap gate. With certain types of alloys, an overlap gate arrangement is preferable whereas with other types of alloys, a mold assembly having an underlap gate is to be preferred to attain castings of superior quality.

The gate assembly 21 is comprised of a series of molds 22 having mold cavities 23 and further includes a first down-sprue passageway 24, an overhead or top runner passageway 25 and a second down-sprue passageway 26. These passageways all coact for the purpose of forming a down-sprue 24*a*, an overhead runner 25*a* and a second down-sprue 26*a*.

As will further be seen from a consideration of FIGS. 7 and 8, the mold assembly 21 is further provided with a circular disc-shaped passageway 27, a ring-shaped valve insert blank 28 is formable in the cavity 23, and an in-gate 29 is formed between the cavity 28 and the second down-sprue passageway 26 so that molten metal can be caused to flow through the various passageways 24, 25 and 26 into the mold cavities 23.

Figure 9:
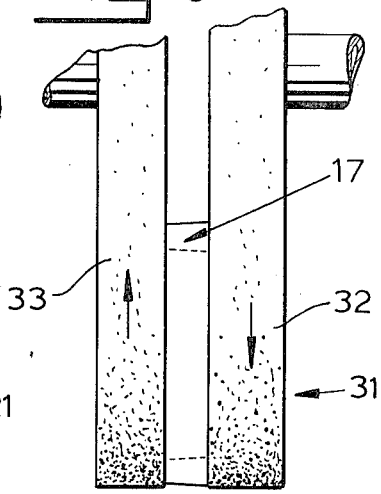
FIG. 9 is a diagrammatic illustration of a face grinding operation for valve seat rings.
Figure 10:
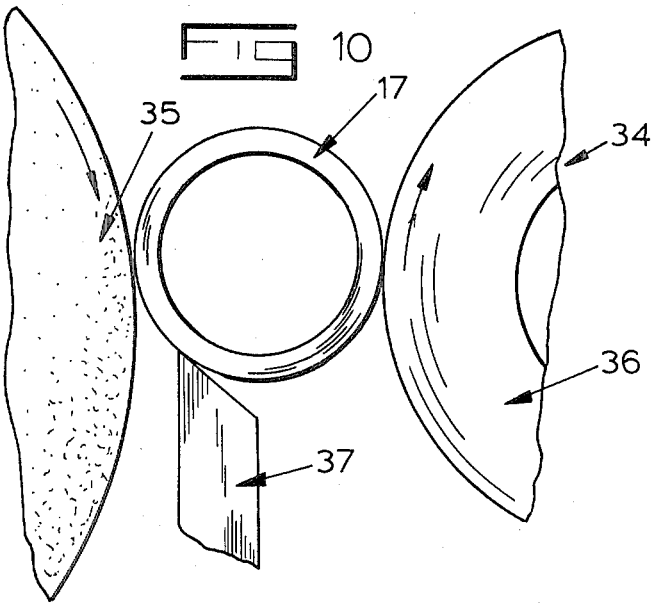
FIG. 10 is a fragmentary side elevational view of the grinding operation for grinding the O.D. of the valve seat.
Figure 11:
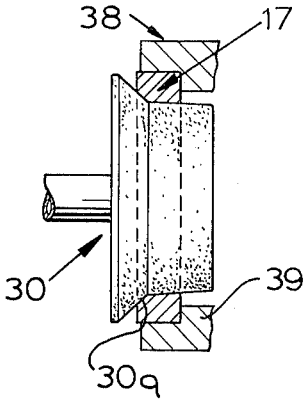
FIG. 11 is a fragmentary assembly view of the valve seat and grinders for grinding the seat angle on the valve seat insert.
Figure 13:
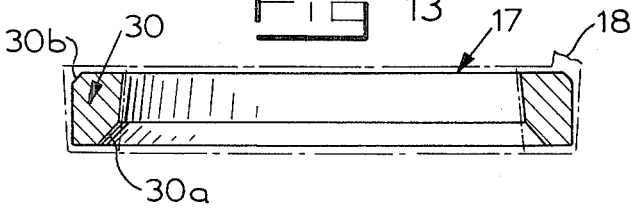
FIG. 13 is a sectional view through the valve seat ring illustrating the same after completion of the various machining operations and with the broken lines illustrating the blank prior to being machined.

In FIGS. 9, 10 and 11, various types of apparatuses are shown for the purpose of transforming the valve seat blank 17 or the blank 28 from an unfinished state to a finished valve seat insert 30. The effects of the grinding operation can be seen from a consideration of the full and dotted line showing of the blanks 17 and the finished valve seat insert 30 in FIG. 13. It will thus there be seen in FIG. 13 how the axial and circumferential surfaces of each of the blanks 17 are ground to shape.

In FIG. 9, a typical apparatus 31 is shown for grinding the axial faces of the blank 17 to shape. To this end, a pair of motor driven grinding wheels 32 and 33 are engaged against opposite surfaces of the blanks 17 for this machining operation.

In FIG. 10, a centerless grinding machine 34 is illustrated for the purpose of grinding the outer circumference of the blanks 17 to shape. To this end, a power-driven grinding wheel 35 is engaged against the outer circumferential surface of the blank 17. The blank 17 is driven by a regulating wheel 36 to cause the blanks 17 to rotate as the grinding wheel is engaged against the outer circumference of the blank 17. In order to hold the blank 17 in position, a stop 37 is provided.

In FIG. 11, a grinding wheel apparatus 38 is illustrated for grinding the inside I.D. or circumferential surface of the valve seat blank 17 and also for the purpose of grinding beveled valve seat or face 30*a* to a finished state. A holder or chuck 39 is provided to hold the blank 17 in position as the grinder 38 rotates to finish machine the blank 17 at its I.D. and at the area of its beveled valve face 30*a*.

Figure 12:
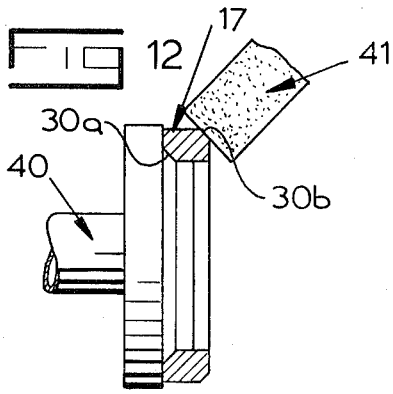
FIG. 12 is a fragmentary vertical section of the valve seat showing the method of grinding the lead-in chamfer.

In FIG. 12, a further apparatus is provided for grinding a lead-in chamfer 30*b* into the blank 17. To this end, a rotary tool holder 40 is provided for supporting the blank 17 for rotating the same. Positioned in adjacency to the blank 17 is a rotating grinding wheel 41 which is the means for grinding the lead-in chamfer 30*b*.

It will be appreciated that the equipment for grinding the various surfaces of the blank 17 is more or less of a conventional nature and the various mechanisms can be varied and the order of the machining of the surfaces of the blank 17 can be varied as may be required.

I claim as my invention:

1. A method of manufacture of valve seats which comprises forming a series of vertically stacked molds each having at least one mold cavity with a configuration approximating that of a ring-shaped valve insert, stacking and connecting the formed molds by a common molten metal passageway in such a way that the passageway connects with an axially facing outer surface of each mold cavity to provide a lap gating relationship, pouring molten metal into the lap gated passageway to form a series of valve insert blanks each having a gate formed on an axially outer face, removing blanks from the molds, and grinding the axially outerfacing surfaces of the blanks to remove the gates.

2. The method of claim 1 is further characterized by each mold having a series of mold cavities disposed in axially lapped relation with respect to the molten metal passageway in communication therewith to enable molten metal to flow into the cavities provided in each of the molds and thus forming the axially facing gates on the valve insert blanks.

3. The method of claim 2 further characterized by the molten metal passageway being positioned in underlapped relation to each of the mold cavities.

4. The method of claim 2 further characterized by the molten metal passageway being positioned in overlapped relation to each of the mold cavities.

5. A mold assembly for the manufacture of valve seat blanks comprising a series of vertically stacked molds, at least some of said molds each having a mold cavity with a configuration approximating that of a ring-shaped valve insert, said stacked molds having a common vertically extending molten metal passageway disposed in radial agency to said mold cavities, each of said molds having said mold cavities also having a generally axially extending gate passageway in lapped relation with the associated mold cavities and in fluid connection with said molten metal passageway thus enabling valve insert blanks to be formed with gates existing only at axially outer faces of the blanks.

6. The mold assembly of claim 5 further characterized by said axially extending gate passageways being in underlapped fluid connection with the associated mold cavities.

7. The mold assembly of claim 5 further characterized by said axially extending gate passageways being in overlapped fluid connection with the associated mold cavities.

8. The mold assembly of claim 5 further characterized by said mold cavities being arranged in clusters radially about said vertically extending molten metal passageway in each of said molds having said mold cavities.

9. The mold assembly of claim 5 further characterized by said axially extending passageway being connected to a runner passageway and to a second vertical molten metal passageway with all of said passageways being in fluid connection.

10. The mold assembly of claim 5 further characterized by said common vertically extending molten metal passageway being connected to a series of vertically spaced circular disc-shaped passageways located in said molds each of which having a diameter such as to link the cavities in a given one of said molds to said common vertically extending molten metal passageway and with said disc-shaped passageways defining said axial gate passageways.

11. The mold assembly of claim 10 further characterized by said mold cavity being formed on one side of its associated mold and said circular disc-shaped passageway being formed on an opposite side of the same mold to facilitate manufacturing.

12. The apparatus of claim 5 further characterized by at least one of said mold cavities being provided on one side of the associated mold and with said gate passageway being provided on an opposite side of the same mold to facilitate manufacture thereof.

* * * * *